United States Patent [19]

Fletcher

[11] 4,156,417

[45] May 29, 1979

[54] RELEASE DEVICE

[76] Inventor: James D. Fletcher, P.O. Box 218, Bodfish, Calif. 93205

[21] Appl. No.: 893,328

[22] Filed: Apr. 5, 1978

[51] Int. Cl.[2] ..... F41C 19/00

[52] U.S. Cl. ..... 124/35 A

[58] Field of Search ..... 124/35 R, 35 A, 31, 124/41 R

[56] References Cited

U.S. PATENT DOCUMENTS

| | | | |
|---|---|---|---|
| 2,819,707 | 1/1958 | Kayfes et al. | 124/35 A |
| 3,028,851 | 4/1962 | Drake | 124/35 R X |
| 3,461,852 | 8/1969 | Brothers | 124/35 A |
| 3,749,076 | 7/1973 | Suski et al. | 124/35 A X |
| 3,845,752 | 11/1974 | Barner | 124/35 A |
| 3,874,359 | 4/1975 | Cesin | 124/35 A X |
| 3,916,868 | 11/1975 | Wolfe | 124/35 A |
| 3,929,120 | 12/1975 | Barner | 124/35 A |
| 3,965,884 | 6/1976 | Killian | 124/35 A |
| 4,004,564 | 1/1977 | Castonguay | 124/35 A |
| 4,022,181 | 5/1977 | Fletcher | 124/35 A |
| 4,036,204 | 7/1977 | Scott | 124/35 A |
| 4,066,060 | 1/1978 | Napier | 124/35 A |
| 4,083,348 | 4/1978 | Fletcher | 124/35 A |

*Primary Examiner*—Richard J. Apley
*Attorney, Agent, or Firm*—Donald E. Nist

[57] ABSTRACT

An improved archery bowstring release device is provided which includes a housing having a rear finger-receiving portion and a front portion, the latter with forwardly projecting flanges disposed in vertically spaced relation to define a longitudinal space therebetween. A bowstring draw cord defining a loop is preferably secured to the flanges and projects from the housing. A draw cord loop retainer is pivotally secured in the space to the flanges for movement between a locked bowstring-retaining position and an unlocked bowstring-releasing position. If desired, the retainer can be used directly to draw the bowstring rather than utilizing the draw cord, and the draw cord can then be removed from the device. The retainer projects laterally and rearwardly from the housing when in the locked position.

A trigger mechanism is provided which comprises a coupler extending longitudinally in the space and pivotally connected to the flanges adjacent its rear end and to a link adjacent its front end, the link in turn being pivotally secured to the loop retainer. An elongated trigger arm extends longitudinally of the housing and is pivoted thereto so that its front end engages the rear end of the coupler. The arm's rear end extends rearwardly from the housing and is urgeable transversely of the housing by the archer's thumb to cause the front end thereof to force the coupler and link to rotate the retainer from the locked (cocked) position to the unlocked position, thus releasing the bowstring. The retainer can be easily manually moved back to the locked position. The device is inexpensive, durable and efficient, permitting easy, sure and highly accurate and reproducible drawing and shooting of archery arrows.

10 Claims, 6 Drawing Figures

RELEASE DEVICE

BACKGROUND OF THE INVENTION

1. Field of the Invention

The present invention generally relates to sports equipment and more particularly to an improved archery bowstring release device.

2. Prior Art

Various types of mechanical archery bowstring release devices have been developed to improve shooting accuracy. The hook or ledge type is very popular. It usually involves a simple metallic or plastic hand-held ring or the like with a hooked projection adapted to engage the bowstring at a single location. When the bowstring is fully drawn and the bow has been fully aimed, the archer turns the ring or allows it to rotate so that the bowstring suddenly slips off the projection and is released. With such a device it is somewhat difficult to exactly reproduce the angle and movements relating to the draw and release from shot-to-shot. Moreover, there is a danger that during the draw, the archer will inadvertently allow the device to slip, prematurely firing the arrow.

So-called rope releases are more desirable in this respect since they usually involve a more or less slip-proof rope retainer. Moreover, the ropes which wrap around and are used to draw the bowstring dampen undesired inaccuracy-producing bowstring vibrations during release of the bowstring. However, in order to release the bowstring from most rope releases, certain hand movements are necessary which are difficult to reproduce from shot-to-shot.

So-called complex trigger-type releases reduce the hand movements which are necessary to trigger the release of the bowstring but are either so complicated and expensive to make so as to be of doubtful use to the average archer or are subject to substantial wear in use, due to the substantial forces imposed on the sear elements of the trigger.

Accordingly, it would be desirable to provide an improved release device which would be durable and inexpensive, free of rapid wear and simple to use. Such device should be capable of promoting increased shooting accuracy by being capable of being triggered with a minimum of hand movement. Preferably such device could be used in a plurality of shooting modes.

SUMMARY OF THE INVENTION

The present invention satisfies the foregoing needs. It is inexpensive, durable, subject to little wear, highly accurate and capable of being used in two different shooting modes, as desired by the archer. It is substantially as set forth in the Abstract above. The bowstring retainer mechanism when locked holds the bowstring either by itself or through the use of a rope loop so that the bowstring cannot slip off and fire accidentlally. During intentional firing of the bowstring, the retainer smoothly and effortlessly moves to the unlocked position to allow the sudden release of the bowstring. The device can be easily held in the hand, is simple to construct and can be triggered by slight movement of the thumb in a readily reproducible manner. The novel trigger components, that is, the in-line link, coupler and trigger arm are essentially wear-free and are pivotally connected to each other in the housing, the link also being pivotally connected to the retainer. The degree of force needed to exert on the trigger arm to effect the firing can be easily controlled. Various other features are set forth in the following detailed description and the accompanying drawings.

DRAWINGS

DETAILED DESCRIPTION

Figure 1:
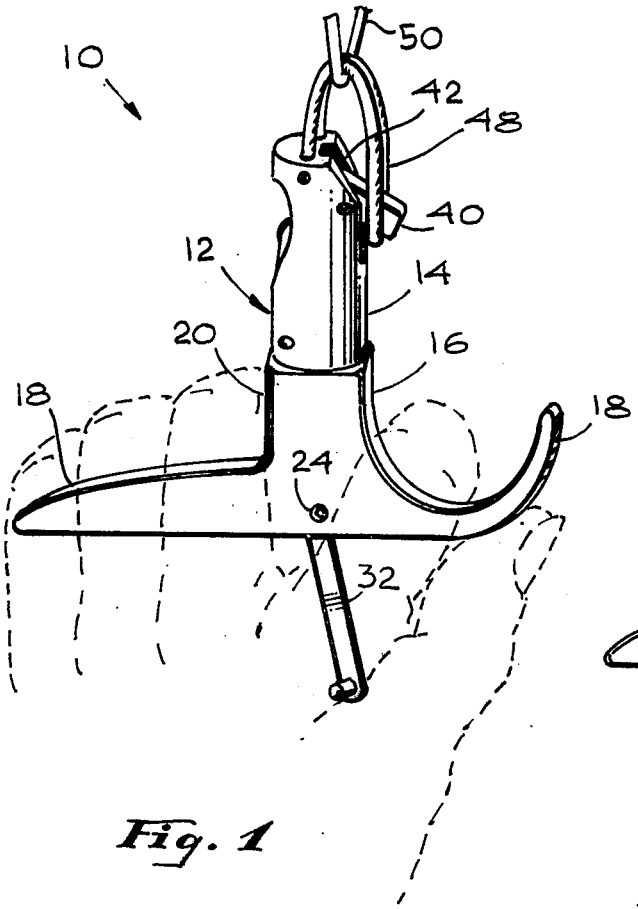
FIG. 1 is a schematic top plan view of a preferred embodiment of the improved release device of the invention in a cocked or locked position with the rope loop thereof around a bowstring and with the archer's hand in phantom outline.
Figure 3:
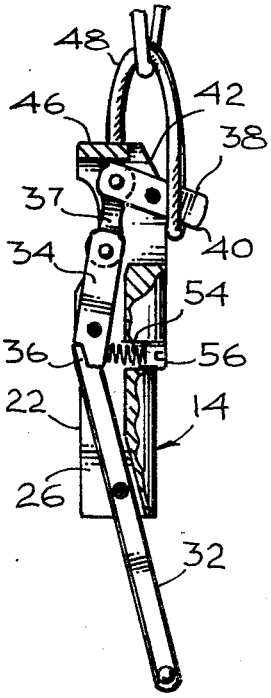
FIG. 3 is a schematic top plan view, partly broken away, of the front portion of the device of FIG. 1 in the locked position.
Figure 5:
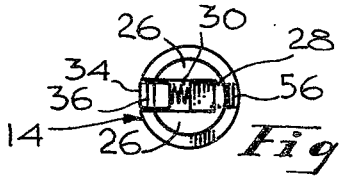
FIG. 5 is a rear end view of the front portion of FIGS. 3 and 4, with the trigger arm removed; and, FIG. 6 is a schematic top plan view of the device of FIG. 1 with the rope loop thereof removed and with the retainer directly engaging the bowstring.

FIGS. 1, 3 and 5

Now referring more particularly to FIGS. 1, 3 and 5, a preferred embodiment of the improved release device of the present invention is schematically depicted therein. Thus, device 10 is shown which comprises an elongated housing 12 comprising a generally cylindrical forwardly extending front portion 14 and a generally transversely extending rear portion 16. Portion 16 is contoured to provide a pair of finger-receiving wings 18 and a central forwardly extending cylindrical tube 20 slip fitted over the cylindrical rear end 22 of portion 14 and pinned in place, as at point 24.

Cylindrical portion 14 comprises a pair of generally vertically spaced flanges 26 joined on one side thereof by a web 28 (FIG. 5) to define a space 30. Within space 30 are disposed in longitudinaly sequence, as shown more particularly in FIG. 3, a trigger arm 32 pivotally secured adjacent its midpoint to flanges 26 and extending rearwardly of housing 12, an elongated coupler bar 34 pivotally secured adjacent its rear end to flanges 26, and releasably contacting the front end of arm 32 at a notched portion 36, and a link 37 pivotally secured adjacent its rear end to the front end of coupler 34 and adjacent its front end to one end of an elongated retainer 38.

Retainer 38 is also pivotally connected at about its midpoint to flanges 26. The opposite end 40 of retainer 38, when in the locked bowstring-retaining first position shown in FIGS. 1 and 3, extends through an opening 42 laterally of housing 12 and at a slightly rearward angle. In this position, retainer 38 is at about a right angle to link 37, coupler 34 and trigger arm 32 and cannot rotate end 40 forward. Both ends of a rope 44 are secured to and extend outwardly of the closed front 46 of housing 12 so that rope 44 forms a closed loop 48 which can be releasably secured around end 40 of retainer 38 (FIGS. 1 and 3) for holding a bowstring 50 for drawing thereof before its release.

FIGS. 2 AND 4

Figure 2:
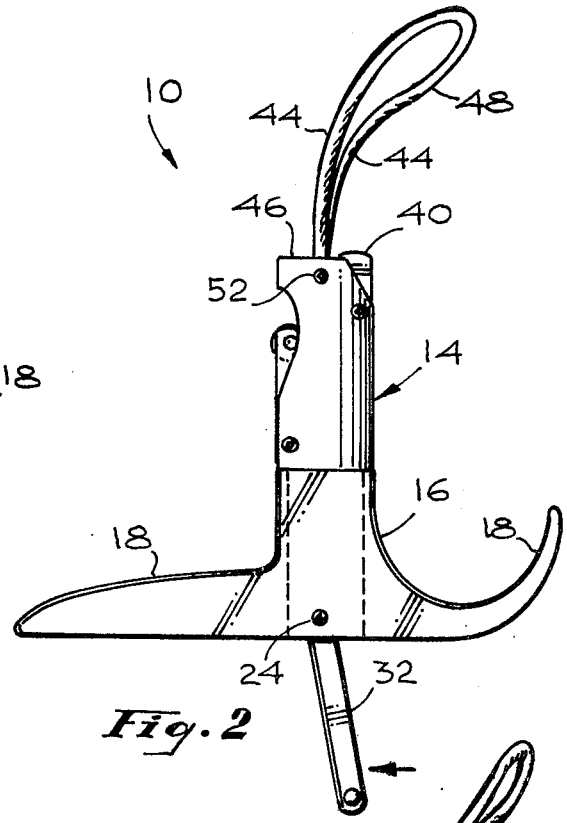
FIG. 2 is a schematic top plan view of the device of FIG. 1 in an unlocked position after release of the bowstring.

In order to release bowstring 50, after fully drawing the same and aiming an arrow attached thereto, the archer urges the rear end of arm 32 transversely in the direction of the arrow in FIG. 2, causing the front end of arm 32 to rotate in the opposite direction, in turn rotating the rear end of coupler 34 in the same direction, and the rear end of link 37 in the opposite direction, that is, in the same direction as the rear end of arm 32. Retainer 38 is, in turn, rotated so that end 40 moves from the transverse loop-holding locked position of FIGS. 1 and 3 to the unlocked position of FIG. 4. During this rotation, loop 48 slips from end 40 and bowstring 50 is suddenly released.

It will be understood that so long as link 37 is in line with coupler 34 (FIG. 3), force applied to end 40 of retainer 38, such as the force applied by the drawn bowstring 50, cannot cause link 37 to rotate. It is only when arm 32 is moved, as described above, so that link 37 comes out of direct alignment with coupler 34, that the bowstring force on loop 48 and end 40 can smoothly and rapidly, essentially and effortlessly cause end 40 to rotate forward to effect the desired bowstring release. It will also be understood that after such release (FIG. 4), because link 37 and coupler 34 are still out of alignment, slight finger pressure applied to end 40 is all that is needed to cause it to easily rotate to the locked (cocked) position of FIG. 1.

FIG. 6

Figure 6:
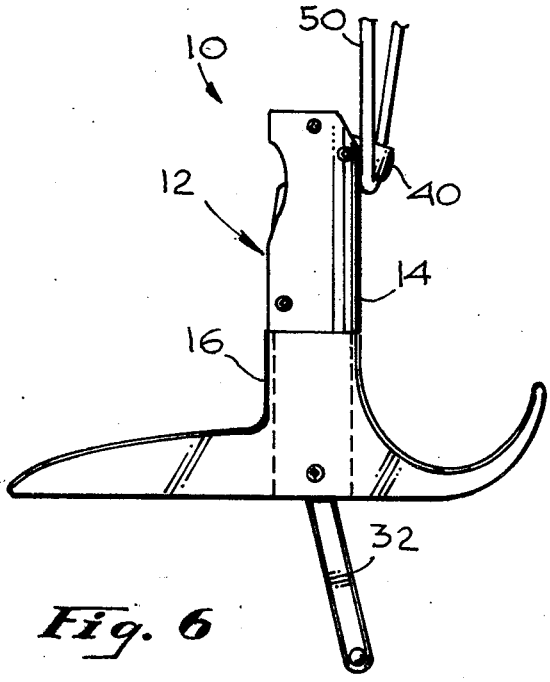

If desired, rope 44 can be removed from housing 12, since it is only retained by set screws 52 or the like, and end 40 itself, when in the locked position (FIG. 6) can be used to draw back bowstring 50 and cause its release, exactly as previously described. This second mode of operation of device 10 renders it highly adaptable to the individual needs of the archer.

Figure 4:
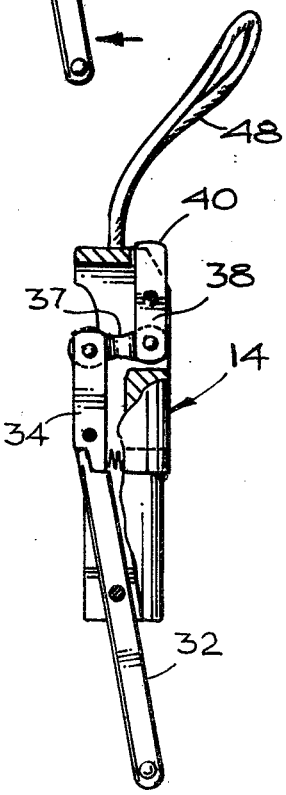
FIG. 4 is a schematic top plan view, partly borken away, of the front portion of the device of FIG. 2 in the unlocked position.

The degree of force needed to be applied to the rear end of arm 32 to cause it to move sufficiently far to cause the firing of the trigger mechanism (release of bowstring 50) can be regulated through the use of a spring 54 in space 30 bearing against one side of the rear end of coupler 34 and adjustable held and positioned by a set screw 56 in housing 12 (FIGS. 3, 4 and 5). Other means of adjusting this force are also contemplated. Spring 54 also assures that coupler 34 will be properly longitudinally aligned with link 37 in the locked position of FIG. 3.

The described improved release device of the invention can be fabricated of metal and/or other suitable components and has been found in practice to be durable, inexpensive and highly efficient. Various modifications, changes, alterations and additions can be made in the present device and its components and parameters. All such modifications, changes, alterations and additions as are within the scope of the appended claims form part of the present invention.

What is claimed is:

1. An improved mechanical bowstring release device comprising, in combination:

a. a housing which includes a rear finger-receiving portion and a front portion, the latter having a pair of forwardly projecting flanges disposed in spaced relation from each other to define a longitudinal space;

b. a retainer pivotally secured between said flanges in said space and including an engaging end capable of movement between a locked bowstring-drawing first position and an unlocked bowstring-releasing second position; and, c. trigger means for locking said retainer in said first position and for urging said retainer into said unlocked second position to release said bowstring, said trigger means including:

i. a coupler extending longitudinally in said space and pivotally secured adjacent its rear end to said flanges, ii. a link in said space pivotally secured adjacent one of its ends to said coupler adjacent the front end of said coupler, and pivotally secured adjacent its opposite end to said retainer at the end thereof opposite said engaging end, and iii. a longitudinally extending trigger arm projecting rearwardly from said housing and pivotally secured thereto in said space behind said coupler, link and retainer, the front end of said arm engaging the rear end of said coupler in said space, whereby movement of the rear end of said trigger arm by the archer effects rotation of said coupler, link and retainer, the latter from said first locked position into said second unlocked position to effect instant release of said bowstring.

2. The improved release device of claim 1 wherein said device includes a bowstring draw cord secured to said flanges and defining a terminal loop projecting from said housing and engageable with said engaging end of said retainer.

3. The improved release device of claim 1 wherein said coupler is disposed behind said link and loop retainer and said flanges are held in generally vertically spaced relation by a web.

4. The improved release device of claim 2 wherein said loop-engaging end of loop retainer projects, when in said locked position, laterally from said device.

5. The improved release device of claim 3 wherein said loop-engaging end also projects rearwardly when in said locked position.

6. The improved release device of claim 2 wherein said loop retainer is directly readily urgeable by finger pressure from said unlocked position to said locked position.

7. The improved release device of claim 1 wherein said link extends longitudinally forward of and in direct line with said couple when said retainer is in said locked position, and wherein said link extends generally at about a right angle to said coupler when said retainer is in said unlocked position.

8. The improved release device of claim 7 wherein in order to effect movement of said retainer from said locked to said unlocked position, said arm causes the front end of said coupler to move out of direct longitudinal alignment with said link.

9. The improved release device of claim 7 wherein said rear portion and said front portion of said housing are generally tubular, wherein said rear portion is detachable from said front portion and wherein said rear portion includes transversely projecting finger-receiving wings.

10. The improved release device of claim 1 wherein said device includes means for adjusting the extent of force necessary to move said trigger arm sufficiently to cause unlocking of said loop retainer and wherein said trigger arm is urgeable generally transversely of said housing.

* * * * *